US008707990B2

(12) United States Patent
Beckman

(10) Patent No.: US 8,707,990 B2
(45) Date of Patent: Apr. 29, 2014

(54) REMOVABLE MANIFOLD FOR AN AIR COMPRESSOR

(75) Inventor: Kurt Richard Beckman, Springfield, MN (US)

(73) Assignee: Mat Industries, LLC, Long Grove, IL (US)

( * ) Notice: Subject to any disclaimer, the term of this patent is extended or adjusted under 35 U.S.C. 154(b) by 779 days.

(21) Appl. No.: 12/827,240

(22) Filed: Jun. 30, 2010

(65) Prior Publication Data

US 2011/0005621 A1 Jan. 13, 2011

Related U.S. Application Data

(60) Provisional application No. 61/223,616, filed on Jul. 7, 2009.

(51) Int. Cl.
*F16K 11/22* (2006.01)
*B60P 3/22* (2006.01)
*F16B 21/10* (2006.01)

(52) U.S. Cl.
USPC ..... 137/565.18; 137/561 A; 137/883; 137/899.4; 403/322.4; 417/234

(58) Field of Classification Search
USPC ..... 137/561 A, 565.18, 861, 883, 899.4; 417/234; 403/322.4, 325, 326, 327, 403/330
See application file for complete search history.

(56) References Cited

U.S. PATENT DOCUMENTS

| | | | | | |
|---|---|---|---|---|---|
| 590,997 | A | * | 10/1897 | Masser | 403/108 |
| 4,165,738 | A | * | 8/1979 | Graves et al. | 128/202.13 |
| 4,712,578 | A | * | 12/1987 | White | 137/271 |
| 4,870,994 | A | * | 10/1989 | Raymond | 137/899.4 |
| 6,655,925 | B1 | * | 12/2003 | Robenalt et al. | 417/234 |
| 7,186,048 | B2 | * | 3/2007 | Robins | 403/109.3 |
| 7,216,672 | B1 | * | 5/2007 | Chen | 137/883 |
| 2008/0044296 | A1 | | 2/2008 | Wood | |

* cited by examiner

*Primary Examiner* — Craig Schneider
*Assistant Examiner* — Jonathan Waddy
(74) *Attorney, Agent, or Firm* — Greer, Burns & Crain, Ltd.

(57) ABSTRACT

A removable manifold for use with an air compressor unit having a main feed hose for dispensing compressed air, the manifold including a body, a hub disposed on the body defining a hub chamber, an inlet disposed on the body, the inlet defining an inlet chamber in fluid communication with the hub chamber, and the inlet being configured to engage the main feed hose, thereby providing fluid communication between the air compressor unit and the hub chamber, and an outlet disposed on the body, and defining an outlet chamber in fluid communication with the hub.

14 Claims, 4 Drawing Sheets

REMOVABLE MANIFOLD FOR AN AIR COMPRESSOR

PRIORITY

This application claims priority under 35 U.S.C. §119(e) to U.S. Provisional Patent Application filed Jul. 7, 2009 having Ser. No. 61/223,616.

FIELD OF THE INVENTION

The present invention relates generally to air compressors, and more specifically to portable air compressors of the type used to power pneumatic tools, such as at construction sites.

BACKGROUND OF THE INVENTION

Air compressors are commonly used to operate various types of pneumatic tools. Like any tool, users often need to move and use the tool from place to place, especially between work locations on a construction site. For example, users often need to move from room to room, or floor to floor at a given construction site. Since even portable air compressors are relatively heavy and bulky, they are often affixed to a wheeled frame, commonly referred to as a wheelbarrow compressor. While these devices provide for improved mobility, they are generally only useful when the compressor needs to be moved along a flat surface such as along the ground at a worksite, or on a ground floor of a building. However, tools often need to be used in hard to reach areas, such as upper floors or rooftops of buildings under construction. For example, accessing a roof typically requires climbing up a ladder. In these applications, it is difficult to carry a wheelbarrow compressor up the ladder. Users of such compressors in these applications need to have ground-based assistants adjust the compressor when necessary, or they need to climb down the ladder to make the adjustments themselves.

SUMMARY OF THE INVENTION

The present removable manifold for a compressor such as a wheelbarrow compressor includes a hub in fluid communication with an inlet and an outlet, wherein compressed air dispensed out of the compressor is channeled in the inlet to the hub, and out the outlet to a pneumatic device. Multiple outlets provide for use of multiple devices all connected to the manifold.

In addition, the present removable manifold features a user-activated mounting mechanism for locking and releasing the manifold to and from the wheelbarrow. This configuration of the mounting mechanism facilitates one-handed operation. Removal of the manifold provides a user with the ability to control the flow of compressed air to permit operation of the pneumatic tools at a location remote from the wheelbarrow compressor.

More specifically, a removable manifold is provided for use with an air compressor unit having a main feed hose for dispensing compressed air. Included on the manifold is a body and a hub disposed on the body defining a hub chamber. The manifold further includes an inlet disposed on the body, defining an inlet chamber in fluid communication with the hub chamber. The inlet is configured to engage the main feed hose, thereby providing fluid communication between the air compressor unit and the hub chamber. In addition, the manifold includes an outlet disposed on the body defining an outlet chamber in fluid communication with the hub.

In an alternative embodiment, the present removable manifold for use with an air compressor unit having a main feed hose for dispensing compressed air includes a body, an inlet disposed on the body and defining an inlet chamber, wherein the inlet is configured to engage the main feed hose, and an outlet disposed on the body defining an outlet chamber in fluid communication with the inlet chamber. Further included on the manifold is a user-activated mounting mechanism disposed on the body and configured to move between a locked position, wherein the manifold is releasably mounted to the air compressor unit, and a released position wherein the manifold is detached from the air compressor unit.

DETAILED DESCRIPTION OF THE INVENTION

Figure 1:
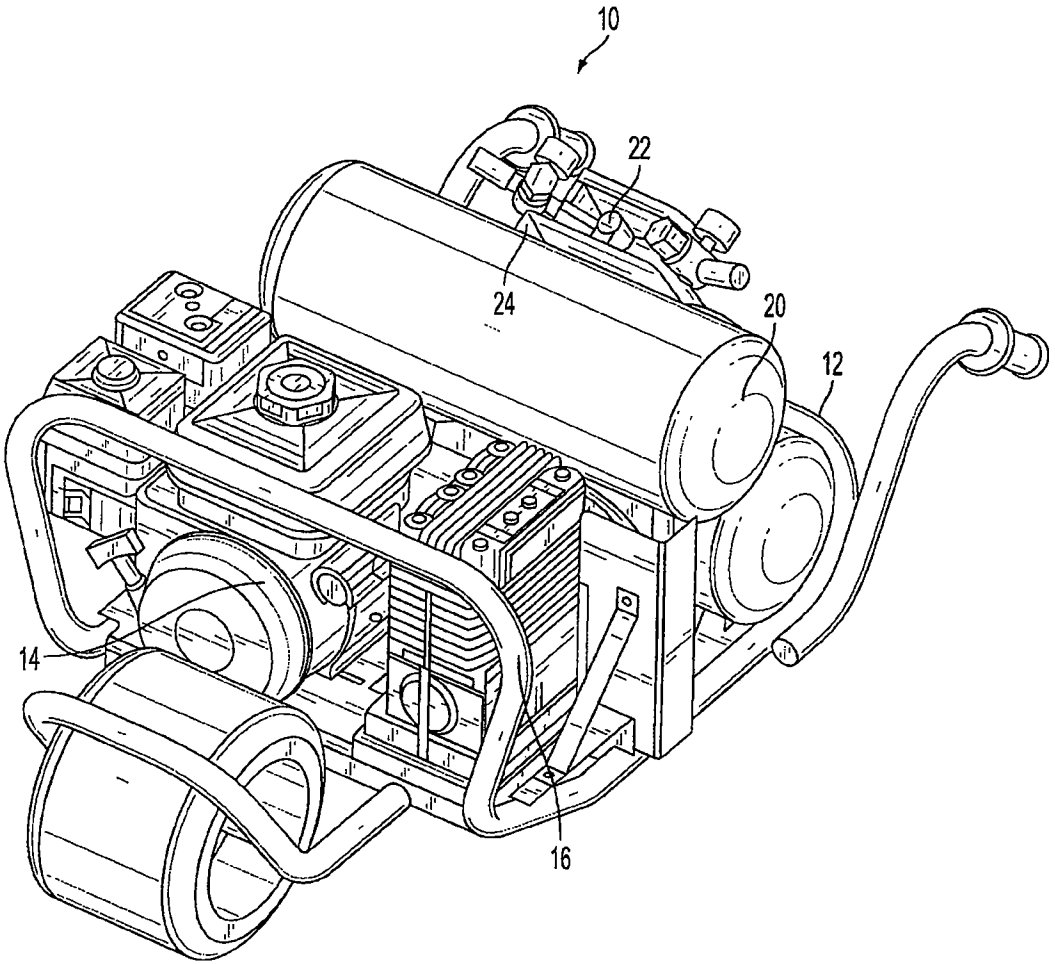
FIG. 1 is a top front perspective view of a wheelbarrow compressor incorporating the present manifold.

Referring now to FIGS. 1-4, in the preferred embodiment, the present wheelbarrow compressor 10 includes a frame 12, an engine 14 mounted to the frame, which powers a compressor unit 16. A main feed hose (not shown) engages a dispenser 18 disposed on the compressor unit 16 for dispensing compressed air. Further included on the wheelbarrow compressor 10 is at least one compressed air storage tank 20 storing compressed air for delivery to the dispenser, and a removable manifold 22 mounted on a generally box-shaped manifold mount 24 secured to the frame.

Figure 3:
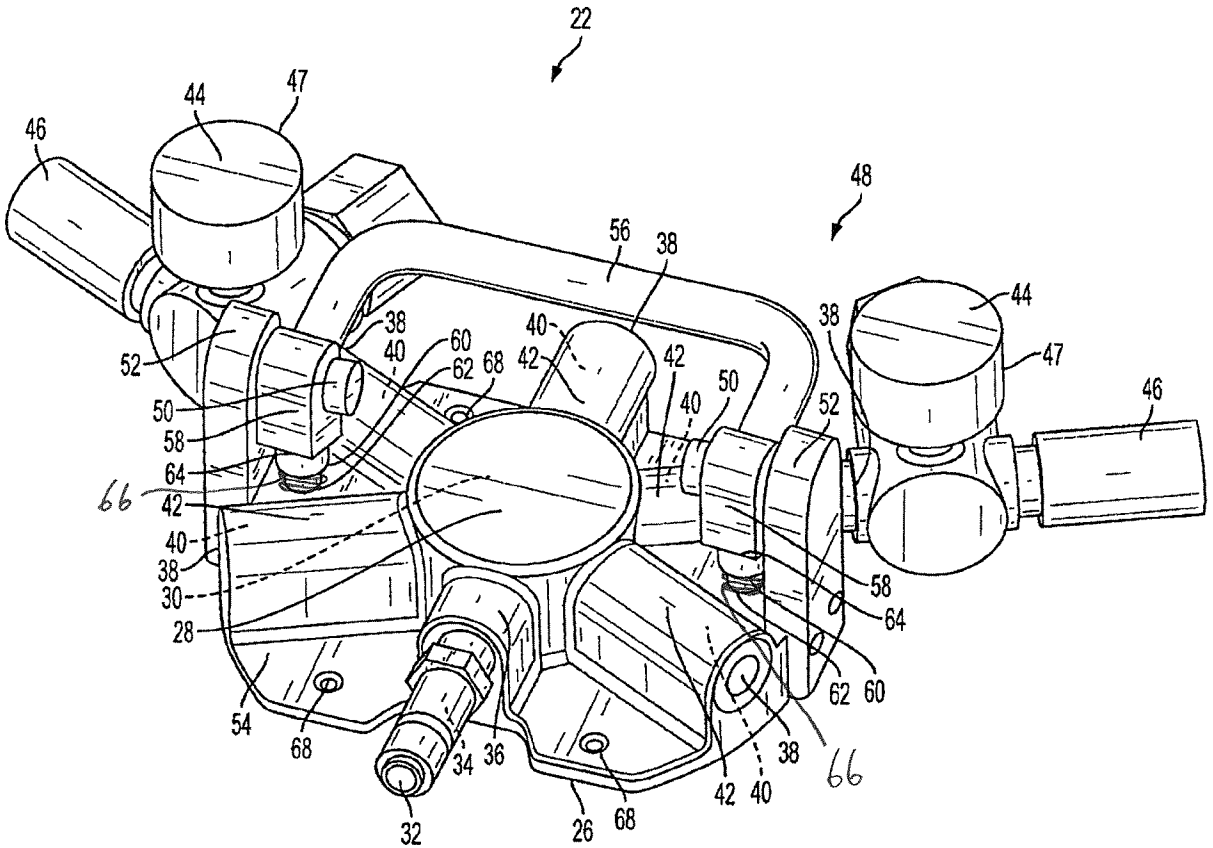
FIG. 3 is a top perspective view of the present removable manifold of the wheelbarrow compressor of FIG. 1.

Referring now to FIG. 3, included on the manifold 22 is a body 26 having a hub 28 defining a hub chamber 30 (shown hidden) and an inlet 32 in communication with an inlet nipple 34, in fluid communication with the hub chamber 30. Configured to engage the main feed hose, the inlet 32 provides fluid communication between the air compressor unit 20 and the hub chamber 30. An inlet arm 36 on the hub 28 receives the inlet nipple 34. The inlet arm 36 provides for easy swapping of nipples having various shapes and sizes (i.e., to fit various types of feed hoses, as is known in the art).

Figure 2:
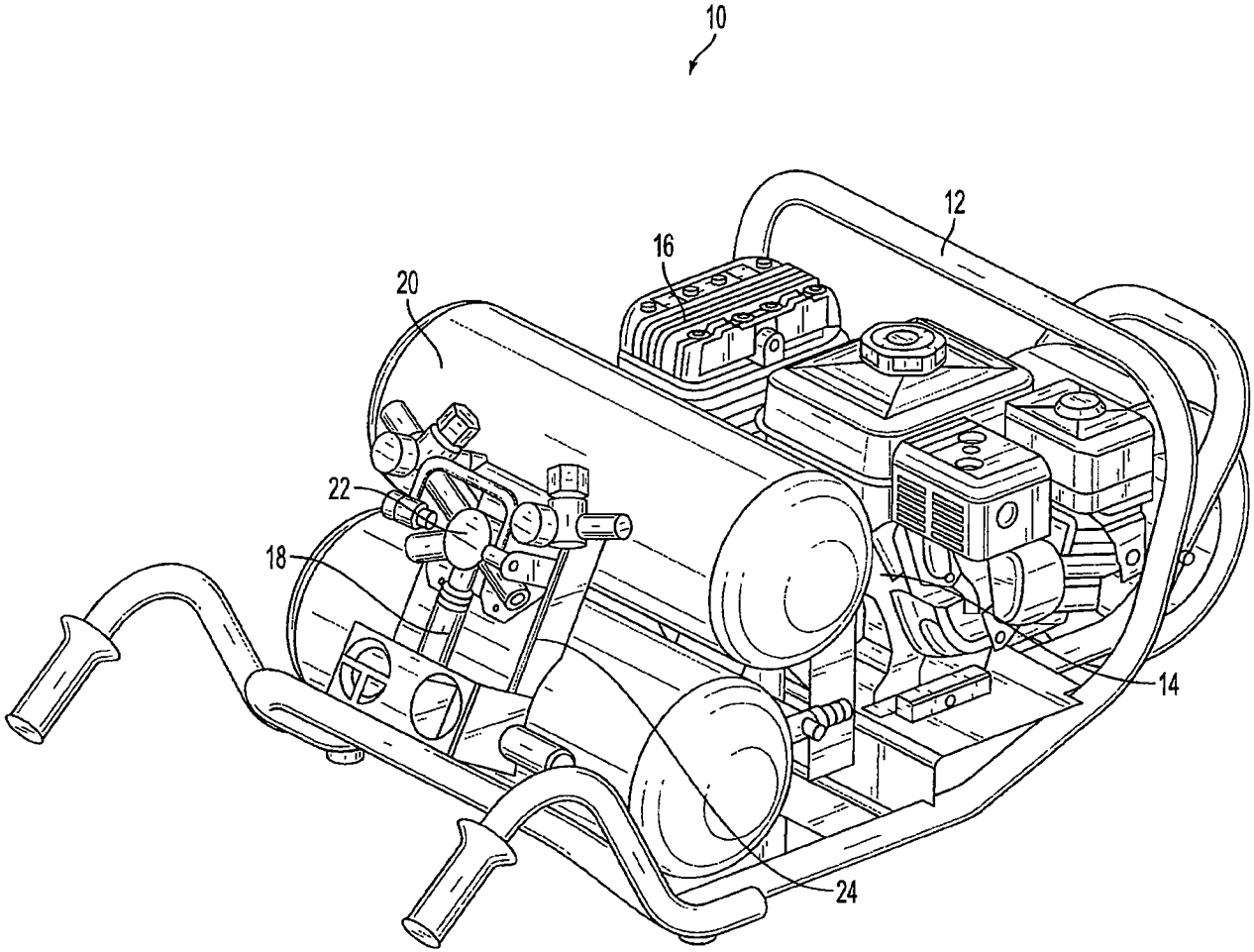
FIG. 2 is a top rear perspective view of the wheelbarrow compressor of FIG. 1.
Figure 4:
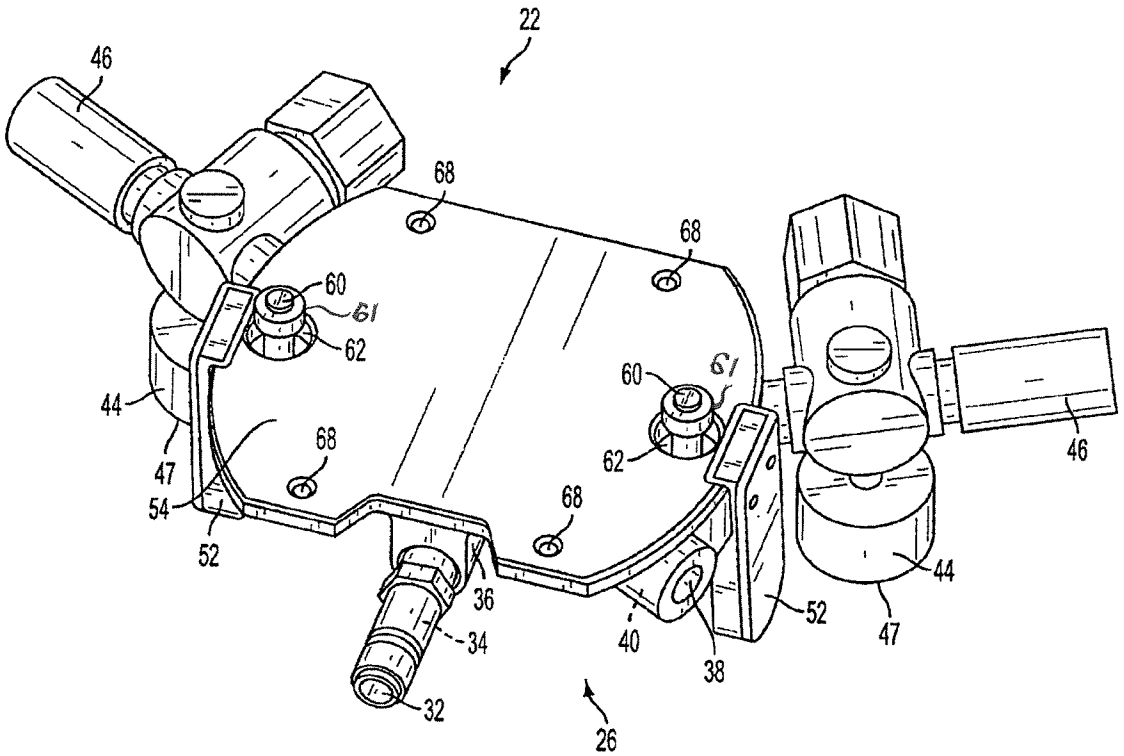
FIG. 4 is a bottom perspective view of the removable manifold of FIG. 3.

Further included on the body 26 is an outlet 38 defining an outlet chamber 40 (shown hidden) being in fluid communication with the hub 28, and which is configured to engage to the main feed hose for fluid communication with the compressor unit 20. Similar to the inlet 32, the outlet 38 includes an outlet arm 42 coupled to the hub 28 and which is configured to engage a tool hose (not shown) for providing fluid communication to a pneumatic tool (not shown). Preferably, the inlet arm 36 and the outlet arm 42 are generally cylindrical and the outlet arm has a length that is greater than a length of the inlet arm. This special length for the inlet arm is designed to accommodate the length of the nipple 34. Also, it is preferred that the body 26 includes a plurality (e.g., five as shown in FIGS. 3 and 4) of outlets 38 and outlet arms 42 such that multiple pneumatic tools can receive compressed air from the manifold 22 at one time. It is also preferred that the inlet arm 36 and the outlet arms 42 are generally evenly spaced around the hub 28. As shown in FIGS. 2 and 3, the nipple 34 provides a male connection type, while the outlet 38 provides a female connection type. Notably, the present manifold is not so limited, and such connection types can be interchanged or otherwise altered to facilitate proper engagement, as is known in the art.

Removable seals (e.g. rubber plugs or the like) (not shown) are provided to releasably seal the inlet 32 or the outlet 38 when not in use to maintain pressure in the remainder of the system. Preferably, a regulator 44 and a gauge 46 are coupled to the outlet 38, wherein the gauge displays pressure set by the regulator, thereby providing the user with control of the compressed air pressure when using the manifold. As is well known, the regulator 44 includes a user actuated control knob 47.

With the above described components, users can channel compressed air from the compressor unit 20 to one or more pneumatic tools, without the need to move the entire wheelbarrow compressor 10. Indeed, the user need only connect the main feed hose between the dispenser 18 on the compressor unit 20 of the wheelbarrow compressor 10 to the inlet 32 of the manifold. Then, users can move the manifold 22 (and the pneumatic tools connected to the outlets 38) to a location remote from the wheelbarrow compressor 10, while still receiving compressed air.

Another feature of the present manifold 22 is a user-activated mounting mechanism generally designated 48, disposed on the body 26 and configured to move between a locked position, wherein the manifold 22 is releasably mounted to the wheelbarrow compressor 10 (on the manifold mount 24), and a released position wherein the manifold is detached from the air compressor unit. At least one, but preferably two pivot pins 50 are associated with the body 26. Each pivot pin 50 is disposed on a generally vertically projecting pivot mount 52 affixed to a generally planar base 54, which is disposed on the body 26.

Preferably, the mounting mechanism 48 is a hand lever configured to rotate about the pivot pins 50 between the locked position the released position, and which has a handle 56 and at least one, but preferably two cam-shaped end portions 58. At least one, but preferably two mounting pins 60 associated with the corresponding cam-shaped end portions 58 are each configured to axially reciprocate between an extended position and a retracted position relative to a corresponding mounting opening 62 disposed on the base 54. A flared end 61 of the mounting pins 60 is disposed opposite a head portion 64 of the mounting pin 60.

On the wheelbarrow compressor 10, the manifold mount 24 is configured to receive the mounting pins 60 when they are in the extended position to secure the manifold 22 in place. This position is utilized when remote compressor control is not needed for storage or transport of the compressor, or when operation of pneumatic tools occurs on the same floor with the compressor 10. It is contemplated that a variety of several different known fastening structures and techniques are suitable for securing the manifold 22 on the wheelbarrow compressor 10 using the extended pins 60 (e.g., friction fit, latches, keyhole latch openings, spring clips or the like).

A biasing device (e.g., a spring) 66, is disposed between the base 54 and the head portion 64 of the mounting pin 60, thereby urging the mounting pin towards the retracted position. However, when the hand lever 48 is in the locked position (shown in FIG. 3), the cam-shaped end portion 58 overcomes the biasing force and applies a force to the head portion 64 of the mounting pin 60 causing it to remain in the extended position. Then, when the hand lever 48 is rotated (i.e., by user actuation) about the pivot pin 50 from the locked position into the released position with the generally "U"-shaped handle 56 extending normal to the manifold 22, the cam-shaped end portions 58 rotate such that a relatively thinner profile engages the pins 60 and provides room allowing the mounting pin to move into the retracted (biased) position. Likewise, when the hand lever 48 is rotated (i.e., by user actuation) about the pivot pin 50 from the released position back into the locked position, the rotation of the cam-shaped end portions removes the space allowing the mounting pins 60 to retract, and overcomes the biasing force of the biasing device by applying a force against the head portion 64 and moving the mounting pins back into the extended position.

When the user removes the manifold 22 from the wheelbarrow compressor 10 (i.e., by moving the hand lever 48 towards the released position), a feature of the present manifold is that it is securable at the remote operational location. Securing openings 68 disposed on the base 54 allow for the user to temporarily fasten the manifold 22 to the ground or to another suitable substrate (e.g., by nailing). Preferably, each of the manifold 22 components described above are directly or indirectly affixed to the base 54, such that they remain secured when the base is fastened to the desired surface.

Throughout the entirely of this application, reference to a, an, or the refers to at least one, unless otherwise specified. While particular embodiments of the present removable manifold for an air compressor have been described herein, it will be appreciated by those skilled in the art that changes and modifications may be made thereto without departing from the invention in its broader aspects and as set forth in the following claims.

The invention claimed is:

1. A removable manifold for use with an air compressor unit having a main feed hose for dispensing compressed air, the manifold comprising:

a body including a base and a mounting opening disposed on said base;

a hub disposed on said body defining a hub chamber;

an inlet disposed on said body, said inlet defining an inlet chamber in fluid communication with said hub chamber, and said inlet being configured to engage the main feed hose, thereby providing fluid communication between the air compressor unit and said hub chamber;

an outlet disposed on said body, and defining an outlet chamber in fluid communication with said hub;

a user-activated mounting mechanism disposed on said body and configured to move between a locked position, wherein said manifold is releasably mounted to the air compressor unit, and a released position wherein said manifold is detached from the air compressor unit;

a pivot pin associated with said body, wherein said mounting mechanism has a hand lever configured to rotate about said pivot pin between said locked position and said released position;

a mounting pin associated with said corresponding mounting opening and configured to move between an extended position and a retracted position;

a biasing device configured to urge said corresponding mounting pin into said retracted position, said biasing device being a spring; and said hand lever including a handle portion and a cam-shaped end portion engaging a head portion of said mounting pin, wherein movement of said handle between the locked and released positions causes interaction of said cam-shaped end portion to selectively retract and extend said mounting pin.

2. The removable manifold of claim 1 wherein said inlet further includes an inlet arm coupled to said hub, and said outlet further includes an outlet arm coupled to said hub.

3. The removable manifold of claim 2 wherein said inlet arm and said outlet arm are generally cylindrical.

4. The removable manifold of claim 3 wherein said outlet arm has a length that is greater than a length of said inlet arm.

5. The removable manifold of claim 2 wherein said manifold includes five outlet arms, each having a corresponding outlet.

6. The removable manifold of claim 5 wherein said outlet arms and said inlet arm are generally evenly spaced around said hub.

7. The removable manifold of claim 1 further comprising a regulator and a gauge coupled to said outlet, wherein said gauge displays pressure set by said regulator.

8. The removable manifold of claim 1 wherein said body further includes said base, and wherein said hub, said inlet, and said outlet are disposed on said base.

9. The removable manifold of claim 1 wherein said base includes a securing opening.

10. A removable manifold for use with an air compressor unit having a main feed hose for dispensing compressed air, the manifold comprising:

a body including a base and a mounting opening disposed on said base;

an inlet disposed on said body and defining an inlet chamber, said inlet is configured to engage the main feed hose;

an outlet disposed on said body and defining an outlet chamber in fluid communication with said inlet chamber; and a user-activated mounting mechanism disposed on said body and configured to move between a locked position, wherein said manifold is releasably mounted to the air compressor unit, and a released position wherein said manifold is detached from the air compressor unit;

a pivot pin associated with said body, wherein said mounting mechanism has a hand lever configured to rotate about said pivot pin between said locked position and said released position;

a mounting pin associated with said corresponding mounting opening and configured to move between an extended position and a retracted position;

a biasing device configured to urge said corresponding mounting pin into said retracted position wherein said biasing device is a spring; and said hand lever including a handle portion and a cam-shaped end portion engaging a head portion of said mounting pin, wherein movement of said handle between the locked and released positions causes interaction of said cam-shaped end portion to selectively retract and extend said mounting pin.

11. The removable manifold of claim 10 further comprising a pivot mount disposed on said body, wherein said pivot pin is disposed on said corresponding pivot mount.

12. A removable manifold for use with an air compressor unit having a main feed hose for dispensing compressed air, the manifold comprising:

a body including a base and a mounting opening disposed on said base;

a hub disposed on said body defining a hub chamber;

an inlet disposed on said body defining an inlet chamber in fluid communication with said hub chamber, and wherein said inlet is configured to engage the main feed hose, thereby providing fluid communication between the air compressor unit and said hub chamber;

an outlet disposed on said body and defining an outlet chamber in fluid communication with said hub; and a user-activated mounting mechanism disposed on said body and configured to move between a locked position wherein said manifold is releasably mounted to the air compressor unit, and a released position wherein said manifold is detached from the air compressor unit;

a pivot pin associated with said body, wherein said mounting mechanism has a hand lever configured to rotate about said pivot pin between said locked position and said released position;

a mounting pin associated with said corresponding mounting opening and configured to move between an extended position and a retracted position; and said hand lever including a handle portion having a first end and a second end, each end being associated with said corresponding mounting pin, and a cam-shaped end portion engaging a head portion of said corresponding mounting pin, said head portion being located at an end of said mounting pin, a flared end of said mounting pin being opposite said head portion, said head portion protrudes though said corresponding mounting opening for engagement by said cam-shaped end portion.

13. The removable manifold of claim 12 further comprising an inlet arm coupled to said hub and said inlet, and further comprising an outlet arm coupled to said hub and said outlet.

14. The removable manifold of claim 12 wherein said body further includes said base, and wherein said hub, said inlet, and said outlet are disposed on said base.

* * * * *